US005575384A

United States Patent [19]

Saye

[11] Patent Number: 5,575,384

[45] Date of Patent: Nov. 19, 1996

[54] COMBINED GREETING CARD AND ITEM CARRIER

[76] Inventor: Louis A. Saye, Rte. 3, Box 184A, Chippewa Falls, Wis. 54729

[21] Appl. No.: 321,799

[22] Filed: Oct. 12, 1994

[51] Int. Cl.[6] ..... B65D 69/00

[52] U.S. Cl. ..... 206/232; 206/45.28; 206/459.5

[58] Field of Search ..... 206/45.28, 232, 206/486, 45.19, 459.5; 229/87.01, 103.2

[56] References Cited

U.S. PATENT DOCUMENTS

| | | | |
|---|---|---|---|
| Re. 33,503 | 12/1990 | Schluger | 206/232 X |
| 304,459 | 11/1884 | Lambert | D19/2 |
| 319,843 | 9/1885 | Thornell | D19/2 |
| 2,344,437 | 3/1944 | Lande | 206/232 |
| 2,789,753 | 4/1957 | Zimmerman, Sr. | 206/232 |
| 3,621,990 | 11/1971 | Hartman | 206/45.19 X |
| 4,515,838 | 5/1985 | Miyajima | 428/14 |
| 4,917,240 | 4/1990 | Roberts et al. | 206/232 |
| 4,936,462 | 6/1990 | Yoen | 206/232 X |
| 5,038,930 | 8/1991 | Holtkamp, Jr. | 206/232 |
| 5,078,268 | 1/1992 | Olson et al. | 206/232 X |
| 5,081,776 | 1/1992 | Stone et al. | 40/124.1 |
| 5,096,058 | 3/1992 | Juravin et al. | 206/232 |
| 5,226,532 | 7/1993 | Davidson et al. | 206/232 |
| 5,232,087 | 8/1993 | Schluger | 206/232 X |
| 5,277,307 | 1/1994 | Kelly | 206/45.14 |
| 5,282,537 | 2/1994 | Wong | 206/485 |
| 5,289,917 | 3/1994 | Chabria | 206/232 |

*Primary Examiner*—Paul T. Sewell
*Assistant Examiner*—Tara Laster
*Attorney, Agent, or Firm*—Anthony J. Bourget

[57] ABSTRACT

The invention relates to a combined greeting card and commemorative carrier for transmitting a greeting message and transporting a commemorative item where the card has a female greeting panel having a sleeve for receiving a male greeting panel to secure the greeting card about the commemorative item located in the commemorative carrier.

26 Claims, 7 Drawing Sheets

COMBINED GREETING CARD AND ITEM CARRIER

BACKGROUND OF THE INVENTION

1. Field of the Invention

The present invention generally relates to greeting cards and commemorative carriers. More particularly, the present invention relates to a combination greeting card and commemorative carrier and may be referred to as a "Greeting Gift."

2. Related Background Art

There are a variety of designs for greeting cards on today's market. In addition to having the greeting card convey an appropriate greeting, today's cards attempt to capture attention by means of their particular design or other entertaining quality. One of the more increasingly common uses of a greeting card is in conjunction with the transmittal of a package, gift, or similar item. Combining a greeting card and commemorative gift provides for an enhanced commercial product in that a consumer wishing to purchase a gift may also provide a greeting card simultaneously. Likewise, a purchaser intending to send a greeting card may also provide a small collectible or gift. Hence, the combined greeting card and gift, or "greeting gift," is an ideal product for satisfying two purposes.

Various greeting gifts have been suggested for transmitting a gift and conveying a greeting. Suggestions have been made for attracting attention or providing a package and message that appeal to purchasers and their intended gift recipients. Additionally, there are traditional concerns regarding protection and transportation of the item and package to be transmitted. Applicant has found that "greeting gifts" employ various means to protect and transport a gift. However, applicant has found no combined greeting card and item carrier which incorporate the concepts of his invention.

The background patented art includes patent to Schluger, U.S. Pat. No. 5,232,087; Juravin et al. U.S. Pat. No. 5,096,058; Thornel U.S. Pat. Des. No. 319,843; Wong U.S. Pat. Nos. 5,282,537; and Chaberia 5,289,917. These references illustrate various modes of combining a package transmittal and greeting card.

U.S. Pat. No. 5,232,087 discloses a combination product transmittal package and greeting card having a plurality of panels operatively arranged into a rectangular compartment to receive a product. The reference discloses use of a panel to optionally allow greeting card service and also to serve as a closure during use of the package for product transmittal. The package is constructed of a sheet of cardboard construction material having various panels and fold lines and manufactured with the use of an appropriate adhesive or glue. The use of a double-ply panel allows for printing on one side, but provides additional strength that might be required of the package when used as a mailer. The package also includes a zip-strip which permits ready removal of the product from the package. The package can be manufactured in various sizes to receive various items or products.

U.S. Pat. No. 5,096,058 discloses a combined greeting card and candy holder made of a plurality of panels separated by fold lines. In one embodiment a side panel services as a slide closure folder panel in combination with a tuck flap to provide an openable closure with the candy compartment.

Among other features, U.S. Pat. Des. No. 319,843 depicts a combination greeting and gift holding container. The designs illustrate a box type holder being enclosed with a greeting card type panel. Additionally, it can be seen in FIGS. 3 and 13 that the flap is tucked into the back side of the box-like container.

U.S. Pat. No. 5,282,537 discloses a combination photoframe, gift box and greeting card. The device is composed of two swivelable connected panels that open and close with respect to each other. A gift article may be mounted on one of the panels and a greeting inscription may be placed on the panels.

U.S. Pat. No. 5,289,917 discloses a combined greeting card and flashing light gift package. The product is made from a single blank of appropriate paper and contains several panels and fold lines. The product includes a flexible bubble through which backlighting of a greeting may be activated by a person pressing the side of a battery.

In all the references found by applicant, including the aforementioned as well as U.S. Pat. No. 5,226,532, U.S. Pat. Des. No. 304,459, U.S. Pat. Nos. 5,277,307, 5,081,776, 5,038,930, 4,917,240, and 4,515,838, the gift container and greeting holder device use panels which are folded or otherwise configured to hold an item. Some of the references include tuck flaps to position a particular panel.

None of the above cited references disclose a combined greeting card and item carrier having interconnecting panels using a fold and tuck sleeve closure for conveying a greeting while operating item storage.

SUMMARY OF THE INVENTION

The present invention comprises a novel product which combines a greeting card and an item carrier, i.e., it provides a greeting while carrying an item. The product is conveniently constructed of paper or other pliable material by creating panels and folds to house an item. Particularly, the device comprises a commemorative carrier and interlocking male and female panels for closure of the carrier. The male and female panels interlock by use of a female sleeve in which the male panel is inserted.

A product of this type can be handsomely manufactured, and it has several convenient features that make it desirable for purchase, such as an area for displaying a greeting or pictorial information which may attract a customer and can be pleasing to the gift recipient, a unique and clever sleeve closure which allows for smooth opening and closing operation, fold and tuck panels which nest together and expand upon opening, a cradle area for housing an item such as candy or a commemorative gift, and a hidden cradle compartment for disguising desired parts. The product has a clean, symmetrical shape. The special sleeve, the display area, the hidden cradle and the fold and tuck operations are enticing features to a purchaser or gift recipient.

The product can appropriately transport a gift, collectible, or other commemorative in a secure and displayable manner. A person may open the product in a fashion similar to opening a conventional gift box. After viewing or receiving the contents within, the recipient may place the product in a display position by balancing the product on its edge and have the panels extended for displaying balance. The product may easily be reassembled and the item again stored within by reinserting the male panel into the female sleeve. Use of special sealers, glues, staples or other closing mechanisms is unnecessary, but may be used if desired. Additionally, the product does not have to be torn apart in order to view or receive the internal contents.

One object of the present invention is to provide a novel product which combines a greeting card and an item carrier.

Another object of the present invention is to provide a combination greeting card and gift carrier that utilizes fold and tuck panels which expand, retract, and interlock to secure a gift and present a greeting.

Still another object of the present invention is to provide a greeting gift where the contents can be openly displayed or selectively concealed.

Still another object of the present invention is to provide a novel product having various compartments for item storage and display.

The above as well as other objects of the present invention will become apparent when reading the accompanying descriptions and drawings.

DETAILED DESCRIPTION OF THE PREFERRED EMBODIMENTS

Figure 1:
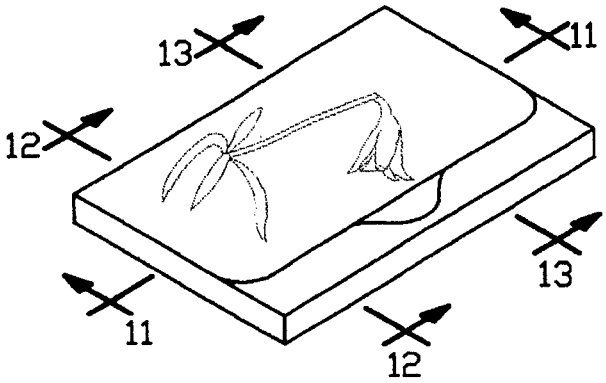
FIG. 1 shows a perspective view of the product which combines a greeting card and an item carrier in a condition in which the panels are closed and serve as a greeting card and closure of the internal item.

Referring now to all the drawings, there is shown a product 10 combining the features of a greeting card 11 and an item carrier 12. The product 10 has an item carrier 12 for receiving an item 14 such as candy or a collectible item, the item carrier 12 is also used as a photograph area to display photograph or drawing. The item carrier 12 has a wall 16 of selected depth and bounds a corresponding item or commemorative storage area 18. The storage area 18 can be of a variety of shapes or sizes and preferably is shaped to snugly receive the item 14. The item 14 can be a sculptured piece having a design or graphic material 20.

The product 10 contains a female greeting panel 22 which is pivotally attached to the item carrier 12. The female greeting panel 22 may be attached at any point along the wall 16, including attachment at female attachment line 24 or female delineation line 47. In one embodiment of the invention, the female greeting panel 22 is secured to item carrier 12 by attachment of inner section 44 to wall 16. Having the inner section 44 attached to the commemorative carrier makes it difficult to fold back the female greeting panel 22 and therefore provides for increased protection of the product. Such a feature is practical for use as a mailer and/or item protector. The female greeting panel 22 folds clockwise along the item carrier 12 at the female attachment line 24. The female greeting panel 22 has a female layer 25 and a chord 26 defining a insert sleeve 28. The chord 26 is secured to the female layer 25 by use of female securing tabs 23. The female securing tabs 23 can be folded over chord 26 and then glued or otherwise attached. More preferably, chord 26 can be attached to securing tabs 23 having been previously folded in the direction of arrows A illustrated on FIG. 5. It can be appreciated that chord 26 can be secured to female layer 25 in a variety of ways. Regardless of the manner used, chord 26 should be secured so as to create an appropriate sleeve 28.

Attachment of chord 26 operates to create a sleeve 28 for insertion and removal of a male greeting panel 30. Securing the chord 26 after the securing tabs 23 have been folded conceals the securing tabs 23 from open view. An appropriate graphic, greeting or message may be printed on the chord 26.

The product 10 further comprises a male greeting panel 30 which is pivotally attached to the item carrier 12 at a male attachment line 32. It can be appreciated that the male greeting panel 30 and the female greeting panel 22 can be attached to the item carrier at various positions along the wall 16 including attachment at male attachment line 32 or male delineation line 33. In this embodiment, the male greeting panel 30 is secured to item carrier 12 by attachment of inner segment 48 to wall 16. Inner segment 48 has depth equal to the selected depth of the item carrier 12 which is equivalent to the depth of wall 16. The male greeting panel 30 has a middle segment 34 originating from male attachment line 32 and a second segment 36. The middle segment 34 and second segment 36 are delineated by segment fold 38. The second segment 36 folds clockwise along the segment fold 38 and middle segment 34 folds counter-clockwise about the item carrier 12. In this embodiment of the present invention, the middle segment 34 preferably folds counter-clockwise along the male attachment line 32.

In one embodiment of the invention, the commemorative carrier 12 includes a commemorative carrier sheet 60 folded about horizontal support members 62 and vertical support members 64. The commemorative carrier sheet 60 can secure the horizontal and vertical support members to form a rigid box-like or other structure to hold item 14. The commemorative carrier 12 is also designed to house a stand 15 and a stand-base 17 which facilitate display of item 14. Vertical support members 64 are wrapped by commemorative carrier sheet 60 and present the surface wall 16. Item-cut-out border 66 secures item 14. The item-cut-out border 66 is positioned within the region 67 of the commemorative carrier. Stand-border 68 is designed to secure stand 15 and stand-base 17. Use of the item-cut-out border 66 and stand-border 68 are dimensioned so as to allow a snug fit of item 14, stand 15 and stand-base 17. Vertical cradle supports 70 are positioned within the hidden cradle 72 to provide stability and support of hidden cradle 72. Stand-border 68 can be made of a variety of designs to hold a variety of pieces. Pins 86 can also be used instead of a stand-border 68 to secure items in the hidden cradle 72.

Figure 4:
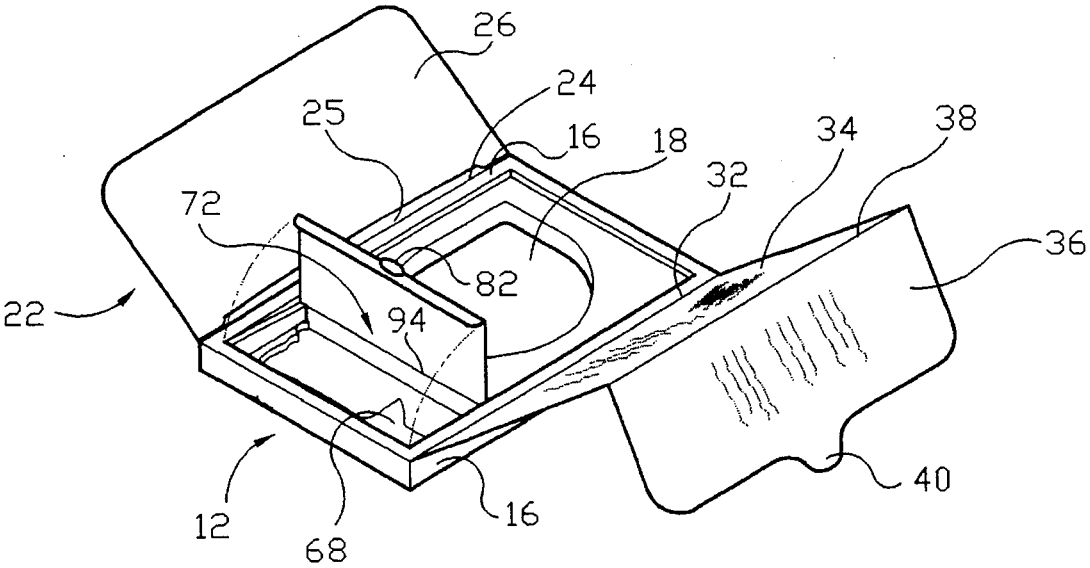
FIG. 4 is a perspective view of the product showing in greater detail the unfolding of the panels thereof to reveal items held within.
Figure 8:
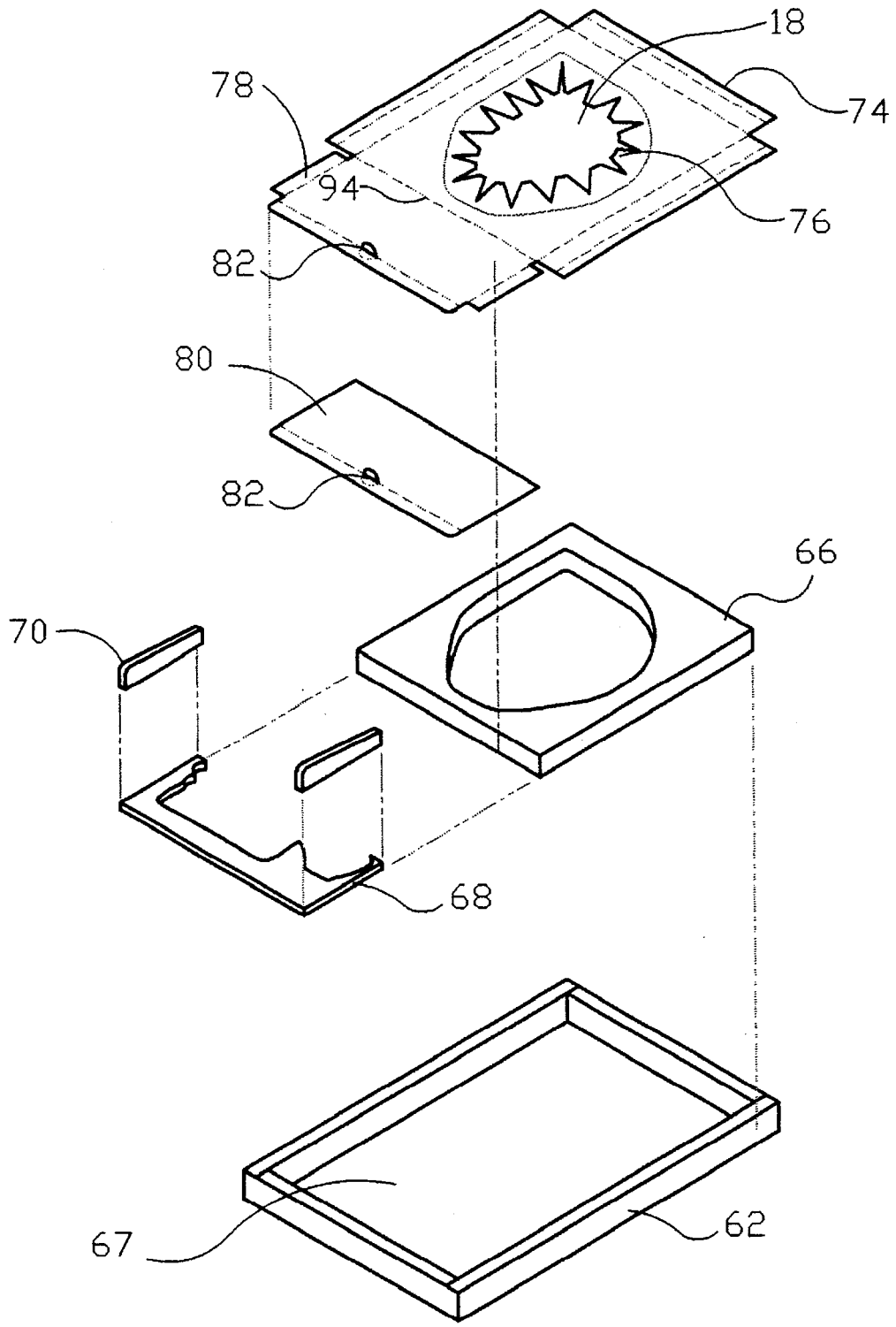
FIG. 8 is an exploded view of the commemorative carrier.
Figure 9:
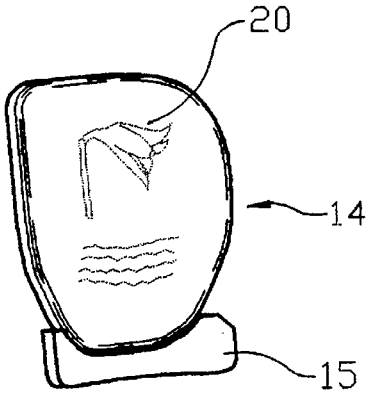
FIG. 9 is a perspective view of a gift or commemorative item to be stored or displayed in the combined greeting card and item carrier.

Face sheet 74 contains panels for wrapping about item-cut-out border 66 to provide a clean look and feel and to operate as further support and structure. Face sheet 74 contains aperture slits 76 which ease in the process of folding about item-cut-out border 66. The aperture slits 76 border item storage area 18. Face sheet 64 includes a display flap 78 which covers hidden cradle 72 when constructed. Display flap layer 80 provides additional support. Commemorative carrier 12 includes lower horizontal edge 94. Flap layer 80 is pivotally attached along lower horizontal edge 94 as shown in FIGS. 4 and 8. Hidden cradle tab 82 allows for ease in operating the display flap 78 to reveal the contents in the hidden cradle 72, particularly the stand 15 and stand-base 17. It can be appreciated that various configurations of the stand-border are contemplated and that various items can be stored in the hidden cradle 72. Additionally, it can be appreciated that the item-cut-out border 66 can be dimensioned so as to accommodate a variety of items.

Figure 6:
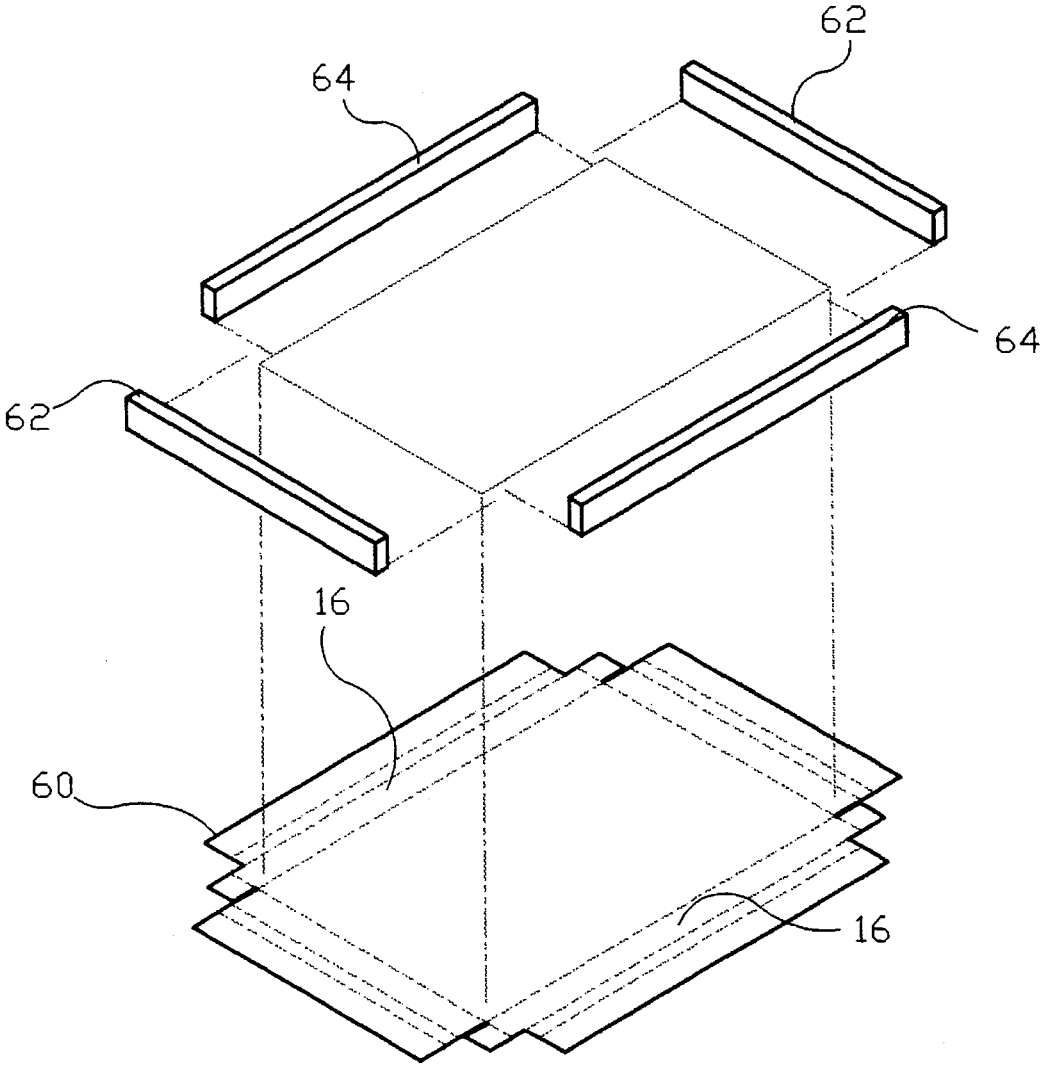
FIG. 6 is an exploded view of a portion of the commemorative carrier showing the carrier in its initial condition as a sheet from which the folding of the various panels provide the three dimensional configuration of the commemorative carrier as shown in FIGS. 3 and 4.
Figure 10:
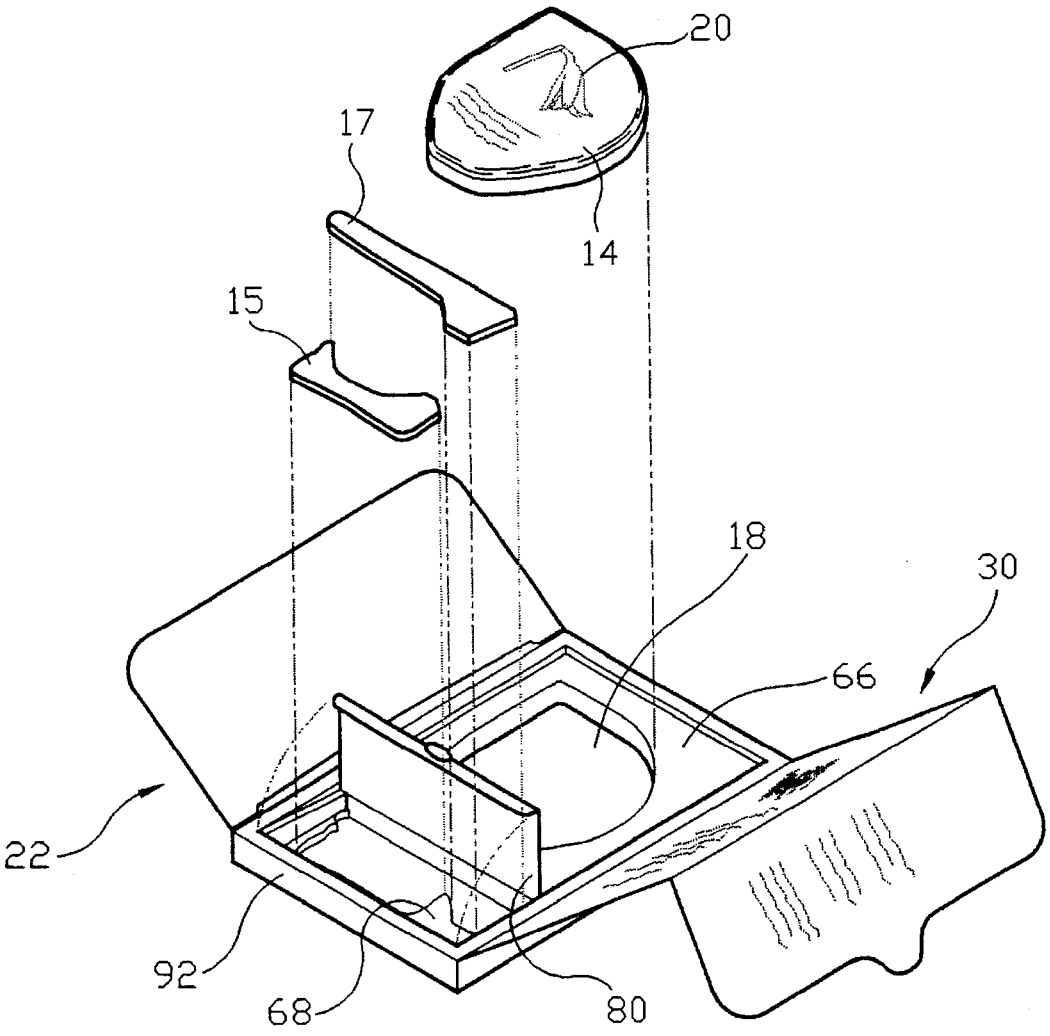
FIG. 10 illustrates the item of FIG. 9 as it is stored in the commemorative carrier.

The commemorative carrier 12 can appropriately be formed of a single plastic or foam piece mold 92 or other rigid material. Mold 92 operates as a base to which female panel 22 and male panel 30 pivotally attach as shown in FIG. 10. Commemorative carrier sheet 60, horizontal support members 62, and vertical support members 64 may also operate as a base as shown in FIG. 6, to which female panel 22 and male panel 30 pivotally attach. Formation can occur in one integrated operation. Additionally, commemorative carrier 12 may contain holding pins 86 to secure the item 14. The holding pins 86 can replace the item-cut-out border 66, they can be integrally molded to the mold 92, or fastened into the commemorative carrier 12. The pins 86 can be of a variety of dimensions so as to properly secure a variety of items. They may also be dimensioned so that the item 14 or multiple items can be snapped into secure position. Storage area 18 can also be bounded by pins 86.

Figure 2:
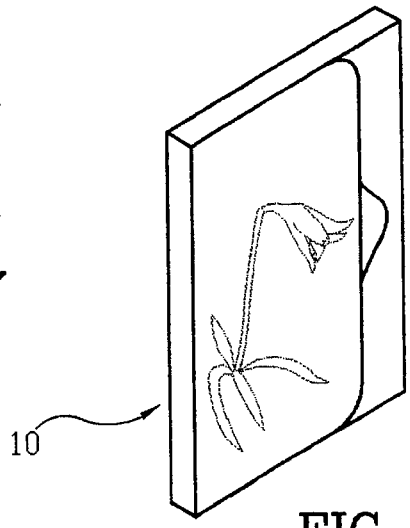
FIG. 2 is a perspective view of the product as it stands vertically.

Once commemorative carrier 12 has been assembled, or formed of mold 92, it is attached to base panel 84. In operation of the product 10 the male greeting panel 30 is folded along the segment fold 38 and inserted into sleeve 28 so that the product 10 can be closed to a position illustrated in FIG. 1 and FIG. 2. In closed position, the outer edge of female greeting panel 22, and the outer edge of outer segment 36 align. That is, they end or rest at an equal distance from male attachment line 32.

Figure 5:
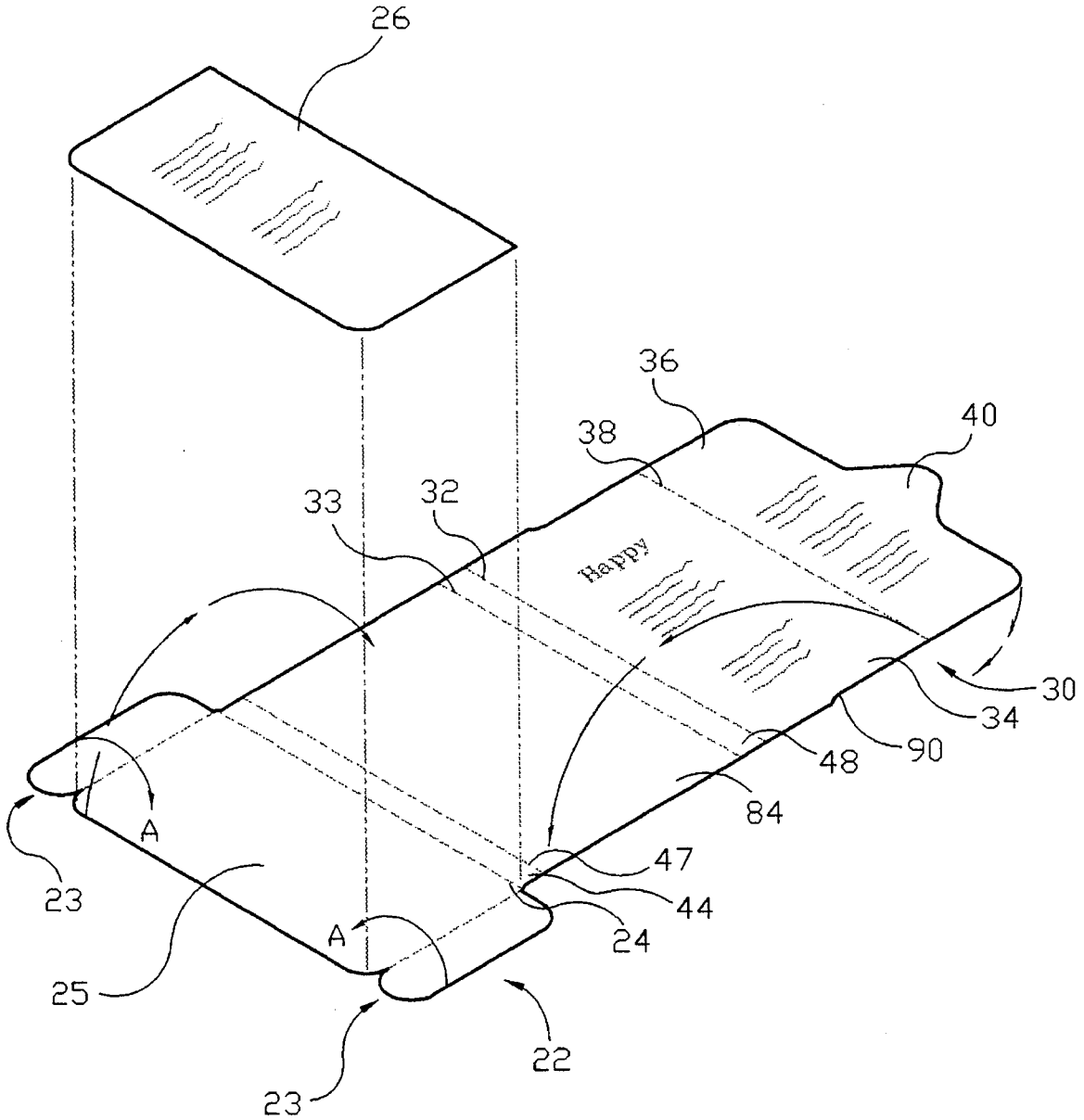
FIG. 5 is a perspective view showing the product panels in their initial condition as a sheet and from which the folding of the various panels provide the three dimensional configuration of FIGS. 1–2.
Figure 7:
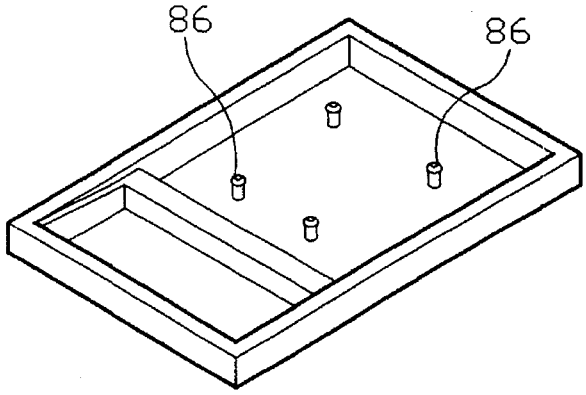
FIG. 7 is a perspective view of the commemorative carrier which was constructed of a mold.

Male greeting panel 30 includes taper 90 which allows for efficient insertion of male panel 30 into sleeve 28. Taper 90 can be of various lengths and is preferably of a length so that insertion of the male panel 30 results in complete insertion into sleeve 28 with no excess taper or gap showing. Male greeting panel 30 may include more than one taper 90 and preferably includes a taper 90 symetrically located along each of its sides as shown in FIG. 5. When product 10 is thus closed, product 10 protects internal item 14 which is secure for transport while providing greeting service. Moreover, when male greeting panel 30 has been inserted into sleeve 28 of female greeting panel 22, the panels are sufficiently locked so that they do not release until tab 40 is pulled. When tab 40 is pulled, chord 26 mechanically forces a bend in male panel 30 to reduce or eliminate binding of male panel 30 during opening operation.

Figure 3:
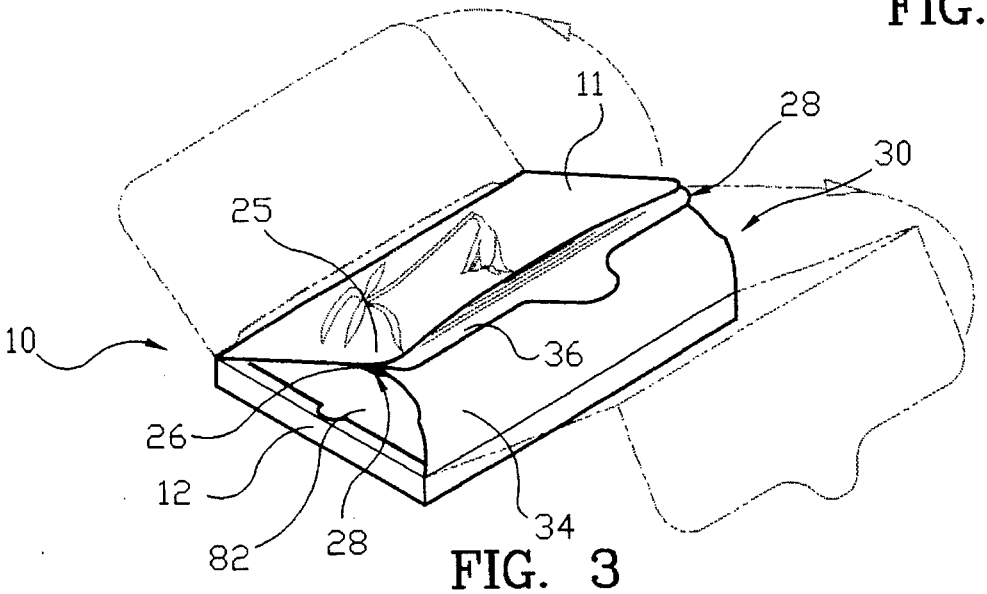
FIG. 3 is a perspective view illustrating the unfolding of the product as shown in FIG. 1.
Figure 12:
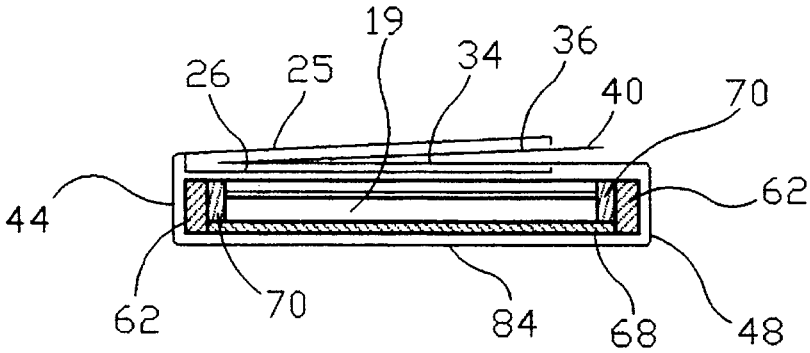
FIG. 12 is a cross-sectional view of the greeting gift of FIG. 1 as seen along lines 12—12 of FIG. 1.

FIG. 3 shows male greeting panel 30 bending during opening operation. Specifically, middle segment 34 exhibits a bent formation. Chord 26 is seen in FIGS. 3, 5 and 12 and is attached to female layer 25 to create sleeve 28. When tab 40 is pulled, second segment 36 and middle segment 34 slide out from sleeve 28. Elimination of chord 26 would eliminate sleeve 28, resulting in male greeting panel 30 being removed from beneath female greeting panel 22 without bending as shown in FIG. 3.

As shown in FIG. 5, chord 26 extends the entire length of female layer 25. By extending the entire length, chord 26 forces male greeting panel 30 to bend at each point along chord 26 when tab 40 is pulled. Chord 26 thus mechanically forces a uniform bend along the entire length of male greeting panel 30 as shown. Were chord 26 eliminated, or even if it did not extend the entire length of female layer 25, middle segment 34 would tend to bow away from female layer 25, or collapse, when tab 40 is pulled. Collapse of segment 34 causes male panel 30 to bind during opening operation. When segment 34 binds, or tends to bow away from female layer 25, the product does not operate smoothly. Chord 26 mechanically forces the bend in male panel 30 as shown in FIG. 3, which results in smooth operation.

Figure 13:
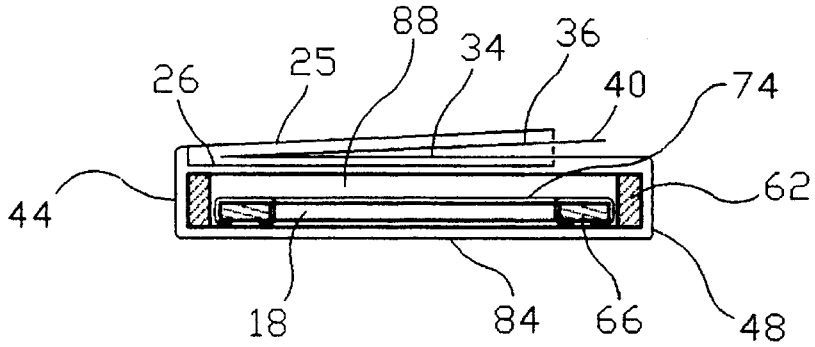
FIG. 13 is a cross-sectional view of the greeting gift of FIG. 1 as seen along lines 13—13 of FIG. 1.
Figure 11:
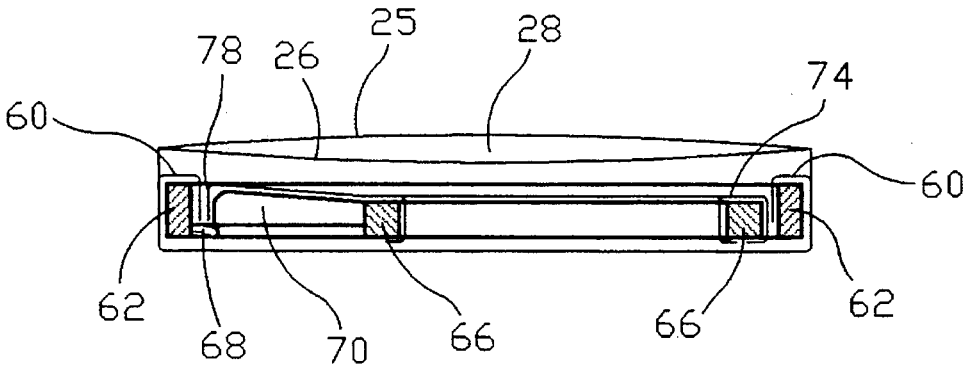
FIG. 11 is a cross-sectional view of the greeting gift of FIG. 1 as seen along lines 11—11 of FIG. 1.

The product 10 may be opened by removing the male greeting panel 30 from sleeve 28. Removal of the male greeting panel 30 is assisted by use of a tab 40 which extends from the male greeting panel 30. Tab 40 is located opposite segment fold 38. Tab 40 may extend a distance less than the selected width of the second segment 36. It can be appreciated however that the width of the tab 40 and the width of the second segment 36 can be equivalent. It is preferable that the tab 40 and the second segment 36 have a combined width equal to the width of middle segment 34. Having a combined equivalent width assures that tab 40 does not extend beyond the width item carrier 12. FIGS. 11 12 and 13 show various cross-sections of the product. FIG. 11 shows sleeve 28 defined by female greeting panel 25 and chord 26. FIG. 12 shows the hidden cradle 72 or stand storage area 19. FIG. 13 shows the item storage area 18. It can be appreciated that the item storage area 18 can be of greater depth to occupy a greater portion of free space 88.

Figure 15:
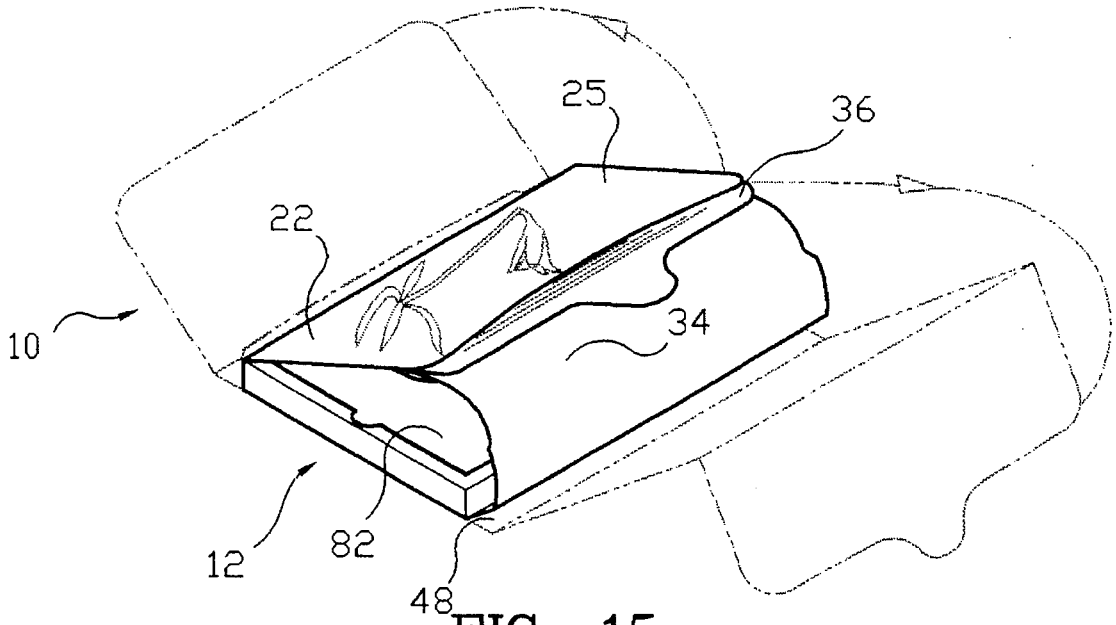
FIG. 15 is a perspective view of a further embodiment of the present invention showing in greater detail the unfolding of the panels thereof to reveal items held within.
Figure 14:
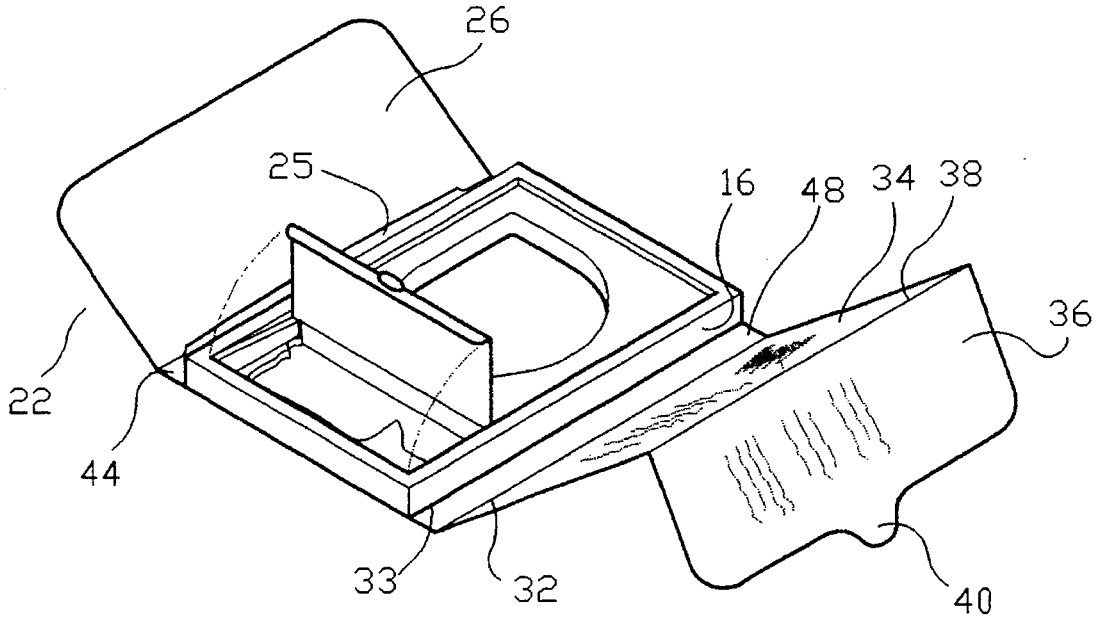
FIG. 14 is a perspective view of a further embodiment of the present invention illustrating the unfolding of the product as shown in FIG. 1.

In a further embodiment of the invention as illustrated in FIGS. 14 and 15, female greeting panel 22 is not secured to item carrier 12 by attachment of inner section 44 to wall 16. Instead, female greeting panel 22 and inner section 44 are both freely attached. Particularly, both female greeting panel 22 and inner section 44 rotate clockwise and are pivotally attached at female delineation line 47. This feature allows the female greeting panel 22 to lie flat in its opened position. Such a configuration facilitates opening of the female greeting panel 22 and assists in standing the product 10 horizontally when it has been opened. Moreover, not having to secure inner section 44 eliminates a step in the manufacture of the product 10. Because the inner section is not secure, female greeting panel 22 is more flexible and assists in removal of the male greeting panel 30. Such design provides an additional feature in the opening of the product to enhance the overall expression of the gift or greeting.

Additionally, in this particular embodiment, inner segment 48 of male greeting panel 30 is not attached to item carrier 12. Foregoing attachment of inner segment 48 to item carrier 12 provides for benefits similar to foregoing attachment of inner section 44 to item carrier 12. Particularly, manufacture of the product is easier, and the unsecured inner segment 48 enhances flexibility, opening, and display of the product. Moreover, since both inner segment 48 and inner section 44 are free to rotate, a combined enhancement of the product 10 is provided. When opening the respective male and female greeting panels, the product 10 unfolds so as to fully expose the commemorative item. Combined with the hidden cradle 72 the product 10 provides the feature of a revealing disclosure, while at the same time having features of secrecy or intimacy.

While particular embodiments of the greeting gift have been shown, it will be appreciated by those skilled in the art that modifications may be made without departing from the invention in its broader aspects and as set forth in the following claims.

I claim:

1. A combined greeting card and commemorative carrier comprising:

a commemorative carrier having a selected depth and bounding a commemorative storage area;

a female greeting panel pivotally attached to said commemorative carrier, said female greeting panel having an insert sleeve for receiving a male greeting panel, said insert sleeve defined by said female greeting panel and a chord extending substantially across a length and width of said female greeting panel; and a male greeting panel pivotally attached to said commemorative carrier at a position opposite said female greeting panel, said male greeting panel having a fold for insertion into said sleeve;

wherein said male greeting panel is folded and alternately inserted into and removed from said sleeve so that said combined greeting card and commemorative carrier can be closed and opened, respectively.

2. A combined greeting card and commemorative carrier according to claim 1 wherein said female greeting panel has a female layer and an inner section delineated by a female attachment line, said inner section having a depth equal to said selected depth, and said female layer folding clockwise along said female attachment line.

3. A combined greeting card and commemorative carrier according to claim 1, wherein said female greeting panel has a double layer defining said sleeve.

4. A combined greeting card and commemorative carrier according to claim 1 wherein said male greeting panel comprises:

an inner segment with a depth equal to said selected depth;

a middle segment originating from said inner segment at a male attachment line and extending to a segment fold; and a second segment extending from said segment fold, wherein said second segment folds clockwise along said segment fold, and said middle segment folds counter-clockwise along said male attachment line.

5. A combined greeting card and commemorative carrier according to claim 1 wherein said commemorative carrier has a base, said female panel and said male panel being pivotally attached to said base.

6. A combined greeting card and commemorative carrier according to claim 1 further comprising a base, wherein said commemorative carrier, said female panel, and said male panel are attached to said base.

7. A combined greeting card and commemorative carrier according to claim 1 wherein said female greeting panel contains a greeting.

8. A combined greeting card and commemorative carrier according to claim 1 wherein said male greeting panel contains a greeting.

9. A combined greeting card and commemorative carrier according to claim 4 wherein said second segment has a tab located opposite said segment fold.

10. A combined greeting card and commemorative carrier according to claim 4 wherein said female greeting panel and said second segment end at an equivalent distance from said position opposite said female greeting panel.

11. A combined greeting card and commemorative carrier according to claim 9 wherein said second segment and said tab have a combined width less than a width of said middle segment.

12. A combined greeting card and commemorative carrier according to claim 1 wherein said insert sleeve has a length greater than a length of said male greeting panel.

13. A combined greeting card and commemorative carrier according to claim 3 wherein said double layer includes a chord, said chord mechanically forcing a bend in said male greeting panel during an opening operation.

14. A combined greeting card and commemorative carrier according to claim 1 wherein said commemorative storage area comprises a commemorative cradle defining an area for storage of an item.

15. A combined greeting card and commemorative carrier according to claim 14 wherein said commemorative cradle comprises at least one pin for securing the item.

16. A combined greeting card and commemorative carrier according to claim 14 wherein said commemorative storage area further comprises a hidden cradle having a flap for concealing contents of said hidden cradle.

17. A combined greeting card and commemorative carrier according to claim 16 wherein said flap is pivotally attached along a lower horizontal edge of said commemorative cradle.

18. A combined greeting card and commemorative carrier according to claim 17 wherein said flap has a tab located opposite said lower horizontal edge.

19. A combined greeting card and commemorative carrier according to claim 1 wherein said commemorative carrier is rectangular.

20. A combined greeting card and commemorative carrier according to claim 1 wherein said sleeve locks said male greeting panel and said female greeting panel.

21. A combined greeting card and commemorative carrier comprising:

a commemorative carrier having a selected depth and bounding a commemorative storage area;

a female greeting panel pivotally attached to said commemorative carrier, said female greeting panel folding clockwise along said commemorative carrier and having a double layer defining an insert sleeve for receiving a male greeting panel, said double layer including said female greeting panel and a chord extending substantially across a length and width of said female greeting panel; and a male greeting panel pivotally attached to said commemorative carrier, said male greeting panel having a middle segment originating from said commemorative carrier and extending to a second segment delineated by a segment fold, said second segment folding clockwise along said segment fold, and said middle segment folding counter-clockwise along said commemorative carrier;

wherein said male greeting panel is folded along said segment fold and alternately inserted into and removed from said sleeve so that said combined greeting card and commemorative carrier can be closed and opened, respectively.

22. A combined greeting card and commemorative carrier according to claim 21 wherein said commemorative carrier has a base, said female panel and said male panel being pivotally attached to said base.

23. A combined greeting card and commemorative carrier according to claim 21 further comprising a base, wherein said commemorative carrier, said female panel, and said male panel are attached to said base.

24. A combined greeting card and commemorative carrier according to claim 21 wherein said female greeting panel contains a greeting.

25. A combined greeting card and commemorative carrier according to claim 21 wherein said male greeting panel contains a greeting.

26. A combined greeting card and commemorative carrier according to claim 25 wherein said greeting includes text and graphic material.

* * * * *